United States Patent [19]

Hoskins

[11] Patent Number: 4,708,050

[45] Date of Patent: Nov. 24, 1987

[54] REDIRECTING BULLET MACHINE

[76] Inventor: Ralph G. Hoskins, 6609 W. Hwy. 22, Crestwood, Ky. 40014

[21] Appl. No.: 834,042

[22] Filed: Feb. 18, 1986

[51] Int. Cl.[4] ..... F41H 5/24

[52] U.S. Cl. ..... 89/36.04; 273/396

[58] Field of Search ..... 2/2.5; 89/36.01, 36.02, 89/36.04, 36.06; 73/167; 273/396, 397, 410

[56] References Cited

U.S. PATENT DOCUMENTS

| | | | |
|---|---|---|---|
| 2,772,092 | 11/1956 | Nikoden | 273/410 |
| 3,701,532 | 10/1972 | Nikoden | 89/36.04 |
| 3,737,165 | 6/1973 | Pencyla | 73/167 |
| 4,512,585 | 4/1985 | Baravaglio | 273/410 |

FOREIGN PATENT DOCUMENTS

| | | | |
|---|---|---|---|
| 156204 | 5/1939 | Fed. Rep. of Germany | 2/2.5 |
| 476343 | 7/1915 | France | 89/36.01 |
| 9223 | 3/1901 | Norway | 89/36.04 |
| 17036 | of 1902 | United Kingdom | 273/410 |

OTHER PUBLICATIONS

Arthur Crouch, Colliers, Sep. 1940.

*Primary Examiner*—Stephen C. Bentley

[57] ABSTRACT

A bullet directing machine used to redirect a bullet from its aimed path includes a back plate having a first section extending upwardly and rearwardly from the bottom to the top of the back plate, and a second section at the top of the first section turning through an angle forming a curve, concavely facing the front of the machine. A top section extends horizontally from the second section in a forward direction. A plurality of ribs extend normal to the first and second sections. A bullet impacting the bullet directing machine will travel upwardly and rearwardly along the first section of the backplate between two adjacent ribs to the second section whereat it is redirected through a curve to the top section.

6 Claims, 10 Drawing Figures

REDIRECTING BULLET MACHINE

BACKGROUND OF THE INVENTION

This invention relates to a bullet machine that guides the bullets back in the direction from which they came. In a military situation this increases your fire power.

This invention could be utilized when it is anticipated that a person may be fired upon. A gun barrel can be used to aim the bullet at one spot.

SUMMARY OF THE INVENTION

Among the objects of the invention may be noted the invention may best used in various places such as windows in buildings, behind or in front of any person being fired at. A small verson can be installed on an automobile. This machine could be used against terrorist. This machine slides or ricochets the bullet back in the direction it came from or the direction you want it to go. Steel plates are angled and curved to redirect the bullet. Gun barrels can be used to direct it at one spot.

In general this intention consists of steel plates at an angle to let the bullets slide against to plates and redirects the bullet in the direction from which it came. There are steel ribs on the plated to guide the bullet where you want it to go. One version consists of a gun barrel to aim back at the person.

DISCRIPTION OF THE PREFERRED EMBODIMENT

Figure 1:
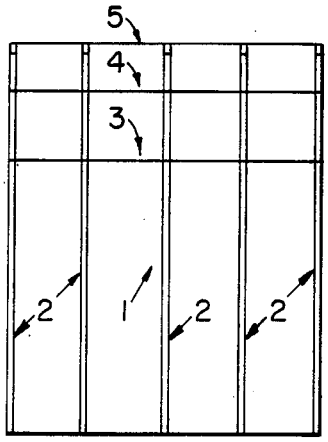
FIG. 1 shows the front view of the plate method.
Figure 2:
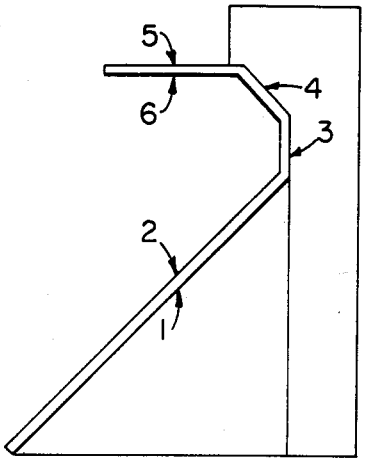
FIG. 2 shows a cross section of FIG. 1.

Referring to the drawing of a redirecting bullet machine, FIG. 1 front view and FIG. 2 cross section show the steel plate 1 lets the bullet slide to steel plate 3 to steel plate 4 to steel plate 5 making the bullet go back in the direction you want it to go. The steel rib 2 (see section in FIG. 3) shows a guide 2 to catch bullets coming from an angle.

The top guider 6 can be adjusted to make the bullet go in different directions.

Figure 3:
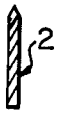
FIG. 3 shows a cross section of a guider plate.

FIG. 3 shows a section of a vertical guider.

Figure 5:
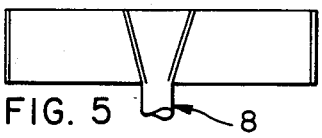
FIG. 5 shows a top view of the curved-plate method.
Figure 4:
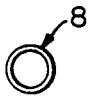
FIG. 4 shows a cross section of the gun barrel.
Figure 6:
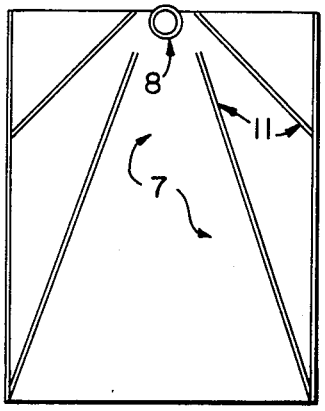
FIG. 6 shows the front view of the curved-plate method with the use of a gun barrel.
Figure 7:
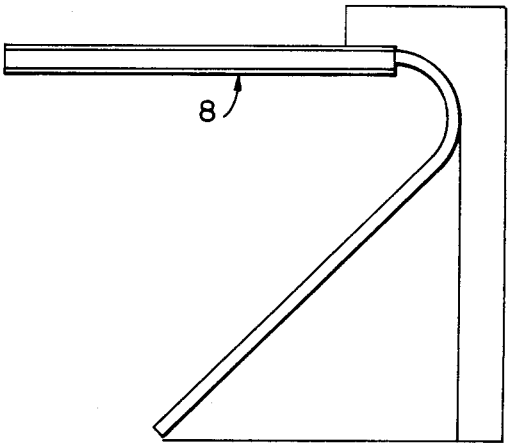
FIG. 7 shows a cross section of the curved-plate method using a gun barrel.

FIG. 5 top view, FIG. 6, and FIG. 7 show a little different method with the bullet being guided into a gun barrel 8 and aimed at certain spots. The gun barrel 8 can be adjusted and aimed. The guiders 11 guide the bullet in the barrel. The curved plate 7 lets the bullets slide around.

Figure 8:
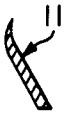
FIG. 8 shows a section of the slanted guider.

FIG. 8 cross section show an angle guider.

Figure 9:
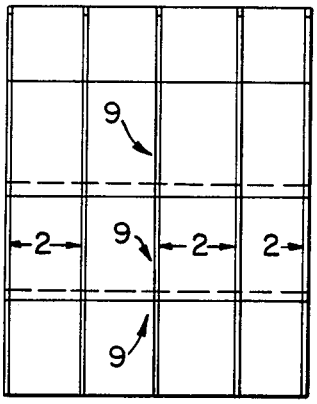
FIG. 9 shows a multi-plate method.
Figure 10:
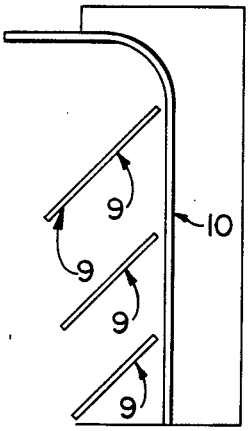
FIG. 10 shows a cross section of the multi-plate method.

FIG. 9 and FIG. 10 show the multi-plated type. This works by letting the bullet hit plates 9 go to plates 10 sliding or bouncing around until the bullets go back in the direction in which they came from.

What is claimed is:

1. A bullet redirecting machine comprising:

back plate means having first and second sections, said first section extending upwardly and rearwardly from bottom to top, away from the front of the machine, said second section adjoining the top of said first section and returning through an angle to form a curve concavely facing the front of the machine and, a top section extending horizontally from said second back plate section toward the front of the machine;

a plurality of spaced apart ribs affixed to said first section and extending outwardly normal to said first and second sections whereby a bullet impacting said first back plate section travels upwardly and rearwardly therealong channeled between two adjacent of said plurality of ribs to said second section whereat it is redirected through the curve to said top section and returned in the direction from whence it came.

2. The bullet redirecting machine of claim 1 wherein said second section is formed of a plurality of flat plates.

3. The bullet redirecting machine of claim 1 wherein said second section is formed as a smooth curve.

4. The bullet redirecting machine of claim 1 wherein said ribs terminate in a knife edge.

5. The bullet redirecting machine of claim 1, wherein said back plate means, said top section, and said ribs are steel.

6. The bullet redirecting machine of claim 1, wherein said top section is a gun barrel for receiving bullets redirected the to second section.

* * * * *